US007694537B2

(12) United States Patent
Ha et al.

(10) Patent No.: US 7,694,537 B2
(45) Date of Patent: Apr. 13, 2010

(54) DOOR FOR DRUM TYPE WASHING MACHINE AND METHOD OF MANUFACTURING DOOR WITH DECORATIVE PART

(75) Inventors: Young Hoon Ha, Masan-si (KR); Bo Yoen Kim, Changwon-si (KR); Jong Seog Gim, Changwon-si (KR); Ji Chang Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 873 days.

(21) Appl. No.: 11/257,069

(22) Filed: Oct. 25, 2005

(65) Prior Publication Data

US 2006/0117813 A1 Jun. 8, 2006

Related U.S. Application Data

(63) Continuation-in-part of application No. 10/992,673, filed on Nov. 22, 2004.

(30) Foreign Application Priority Data

Dec. 30, 2003 (KR) ..... 10-2003-0100251
Dec. 30, 2003 (KR) ..... 10-2003-0100252
Dec. 30, 2003 (KR) ..... 10-2003-0100253
Dec. 30, 2003 (KR) ..... 10-2003-0100254
Dec. 30, 2003 (KR) ..... 10-2003-0100255

(51) Int. Cl.
*D06F 37/28* (2006.01)

(52) U.S. Cl. ..... 68/3 R; 68/196

(58) Field of Classification Search ..... 68/196
See application file for complete search history.

(56) References Cited

U.S. PATENT DOCUMENTS 2,105,248 A 1/1938 Johnson
2,204,551 A 6/1940 Place
2,317,213 A 4/1943 Oliver
2,861,355 A 11/1958 Douglas
3,065,559 A * 11/1962 McKenzie ..... 428/67
3,069,887 A 12/1962 Gould
3,139,784 A 7/1964 Moorman
3,370,738 A 2/1968 Kesling
4,564,557 A 1/1986 Ohgushi et al.
4,665,654 A 5/1987 Stedron et al.

(Continued)

FOREIGN PATENT DOCUMENTS

DE 195 15 040 * 10/1996

(Continued)

OTHER PUBLICATIONS

European Patent Office 1 291 459 Mar. 2003.*

*Primary Examiner*—Frankie L Stinson
(74) *Attorney, Agent, or Firm*—Birch, Stewart, Kolasch & Birch, LLP

(57) ABSTRACT

Disclosed herein are a door for drum type washing machines and a method of manufacturing such a door. A front member is attached to the front surface of a door frame. Consequently, the overall strength of the door frame is increased. Especially, a decorative part, which consists of alternating reflective/nonreflective or embossed/depressed patterns, is formed either at the door frame or at the front member. Consequently, the overall appearance of the door is improved, and glare is effectively prevented.

21 Claims, 15 Drawing Sheets

U.S. PATENT DOCUMENTS

| | | | | |
|---|---|---|---|---|
| 5,496,104 | A * | 3/1996 | Arnold et al. | 312/204 |
| 6,736,470 | B2 * | 5/2004 | Manke et al. | 312/228 |
| 6,840,773 | B2 * | 1/2005 | Anderson et al. | 434/73 |
| D515,260 | S | 2/2006 | Ha et al. | |
| 7,299,666 | B2 | 11/2007 | Geyer et al. | |

FOREIGN PATENT DOCUMENTS

| | | | |
|---|---|---|---|
| GB | 2 114 432 | * | 8/1983 |
| JP | 04-224945 | * | 8/1992 |
| JP | 05-278052 | * | 10/1993 |
| JP | 2001-207648 A | | 8/2001 |
| JP | 2003-291261 | * | 10/2003 |
| WO | WO-02/14593 A2 | | 2/2002 |

* cited by examiner

DOOR FOR DRUM TYPE WASHING MACHINE AND METHOD OF MANUFACTURING DOOR WITH DECORATIVE PART

This application is a Continuation-In-Part of co-pending application Ser. No. 10/992,673 filed on Nov. 22, 2004, the entire contents of which are hereby incorporated by reference and for which priority is claimed under 35 U.S.C. § 120.

BACKGROUND OF THE INVENTION

1. Field of the Invention

The present invention relates to a door for drum type washing machines, and, more particularly, to a door for drum type washing machines wherein the door has a decorative part consisting of continuous reflective/nonreflective patterns or embossed/depressed patterns for preventing glare and improving the overall appearance of the door. Also, the present invention relates to a method of manufacturing a door with such a decorative part.

2. Description of the Related Art

Generally, a washing machine is a machine that is capable of removing pollutants from laundry through mechanical actions carried out by electric power. A drum type washing machine is a kind of washing machine. The drum type washing machine performs a washing operation using friction between a horizontally-mounted drum, which is rotated by a driving force of a motor, and laundry put in the drum under the condition that detergent and wash water are also put in the drum. The drum type washing machine has various effects in that damage to the laundry is minimized, the laundry is not entangled, and the laundry is struck and rubbed.

FIG. 1 is a perspective view showing a conventional drum type washing machine, FIG. 2 is a sectional side view of the conventional drum type washing machine, and FIG. 3 is a cross-sectional view of the conventional drum type washing machine seen from line A-A of FIG. 2.

As shown in FIGS. 1 and 2, the conventional drum type washing machine comprises: a cabinet 2 forming the external appearance of the washing machine; a tub 4 mounted in the cabinet while being suspended by a spring 3; a drum 5 mounted in the tub 4 for receiving laundry; lifters 6 attached to the inner side surface of the drum 5 for lifting the laundry to a predetermined height such that the laundry falls due to gravity from the predetermined height; a motor 7 mounted at the rear of the tub 4 for generating a rotating force; a cabinet cover 17 mounted at the front of the cabinet 2, the cabinet cover 17 having a laundry inlet/outlet hole 18 formed at the center thereof for allowing laundry to be put into or removed from the drum 5 therethrough; and a door 20 hingedly connected to the cabinet cover 17 for closing the laundry inlet/outlet hole 18 to prevent the laundry from being removed from the drum 5 through the laundry inlet/outlet hole 18.

Between the tub 4 and the door 20 is mounted a gasket 8 for diminishing impacts generated when the drum 5 is rotated. Also, the gasket 8 serves as a packing for preventing wash water from leaking from the tub 4.

At the top and bottom parts of the drum type washing machine are mounted a top plate 9, which forms a top surface of the washing machine, and a base 10, which forms a bottom surface of the washing machine, respectively. Under the tub 4 are mounted a draining pump 11 and a draining hose 12, which are used to circulate or drain the wash water. Under the top plate 9 are mounted a water supply hose 13 and a water supply valve 14, which are used to supply wash water into the tub 4, and a detergent box 15, which is used to supply detergent into the tub 4.

Referring to FIG. 3, the door 20 of the conventional drum type washing machine comprises: a ring-shaped door frame 21 hingedly connected to the cabinet cover 17; a door hinge 24, having opposite ends mounted at the door frame 21 and the cabinet cover 17, respectively, for hingedly supporting the door frame 21; and a door glass 25 mounted at an open center hole 21*a* formed at the door frame 21 for allowing a user to look into the drum 5 therethrough.

The door frame 21 is a common injection-molded plastic member. The door frame 21 comprises: a front door frame 22 forming the front part of the door frame 21, the front door frame 22 having a grip 29 formed at one side thereof; and a rear door frame 23 disposed at the rear of the front door frame 22 for forming the rear part of the door frame 21. One end of the door hinge 24 is mounted at the rear door frame 23. From one side of the rear door frame 23 is protruded a hook 27, and the cabinet cover 17 has a hook hole 28, into which the hook 27 is engaged.

The edge of the door glass 25 is fixed between the front door frame 22 and the rear door frame 23 such that the center hole 21*a* of the door frame 21 is sealed.

Recently, design of products has been increasingly focused on marketability in addition to performance and durability of the products. For this reason, appearance, color, and texture of new products are carefully considered, when the products are developed, to satisfy aesthetic desires of consumers.

In the conventional drum type washing machine, however, the door frame 21 is the injection-molded plastic member as described above. As a result, the conventional drum type washing machine does not have a luxurious appearance, and therefore, the marketability of the conventional drum type washing machine is lowered.

In addition, drum type washing machines have become increasingly large. In this case, the sizes of the laundry inlet/outlet hole 18 and the door 20 are increased. Consequently, it is necessary that the door frame 21 have sufficient strength to support load of the enlarged door glass 25. However, the door frame 21 is the injection-molded plastic member, and therefore, it is difficult to increase the strength of the door frame 21.

In order to solve the above-mentioned problem and to provide the drum type washing machine with a luxurious appearance, the door frame 21 may be made of a metallic material having excellent strength. In this case, however, the material costs are increased, the total weight of the door is increased, and surface treatment for texture improvement is very difficult.

SUMMARY OF THE INVENTION

Therefore, the present invention has been made in view of the above problems, and it is an object of the present invention to provide a door for drum type washing machines wherein the door has a front member attached to a door frame for increasing the strength of the door frame, the front member being easily and conveniently replaced if necessary.

It is another object of the present invention to provide a door for drum type washing machines wherein the door has a decorative part consisting of continuous reflective/nonreflective patterns or embossed/depressed patterns formed at the front surface of a door frame or a front member attached to the door frame for preventing glare while improving the overall appearance of the door.

It is yet another object of the present invention to provide a method of manufacturing a door with such a decorative part.

In accordance with one aspect of the present invention, the above and other objects can be accomplished by the provision of a door for drum type washing machines, comprising: a door frame hingedly connected to a cabinet; a door glass supported by the door frame; and a front member attached to the front surface of the door frame, wherein the front member has a decorative part consisting of reflective and nonreflective patterns, which are alternately arranged.

Preferably, the front member is formed in a sheet structure such that the front member is attached to the front surface of the door frame. Preferably, the front member is a metal plating layer formed at the front surface of the door frame.

Preferably, the reflective and nonreflective patterns of the decorative part are alternately arranged in an embossed and depressed structure. Preferably, the embossed and depressed structures are formed by etching.

Preferably, the reflective and nonreflective patterns of the decorative part are arranged in a lattice pattern structure.

Preferably, at least one of the reflective and nonreflective patterns of the decorative part is formed in the shape of a circle, a rectangle, or a triangle.

Preferably, the door further comprises: a protective film for protecting the decorative part.

In accordance with another aspect of the present invention, there is provided a door for drum type washing machines, comprising: a door frame hingedly connected to a cabinet; a door glass supported by the door frame; and a decorative part disposed at the front surface of the door frame, wherein the decorative part consists of reflective and nonreflective patterns, which are alternately arranged.

Preferably, the decorative part is directly formed at the front surface of the door frame.

Preferably, the door further comprises: a metal plating layer formed at the surface of the decorative part.

Preferably, the door further comprises: a metal plating layer formed at the door frame, the decorative part being disposed on the metal plating layer. Preferably, the door further comprises: a protective film coated on the surface of the metal plating layer.

Preferably, the reflective and nonreflective patterns of the decorative part are alternately arranged in an embossed and depressed structure. Preferably, the embossed and depressed structures are formed by etching.

Preferably, the reflective and nonreflective patterns of the decorative part are arranged in a lattice pattern structure. Preferably, at least one of the reflective and nonreflective patterns of the decorative part is formed in the shape of a circle, a rectangle, or a triangle.

Preferably, the door further comprises: a protective film for protecting the decorative part.

In accordance with another aspect of the present invention, there is provided a door for drum type washing machines, comprising: a door frame hingedly connected to a cabinet; a door glass supported by the door frame; and a front member attached to the front surface of the door frame, wherein the front member has a decorative part consisting of embossed and depressed patterns, which are alternately arranged.

In accordance with another aspect of the present invention, there is provided a door for drum type washing machines, comprising: a door frame hingedly connected to a cabinet; a door glass supported by the door frame; and a decorative part disposed at the front surface of the door frame, wherein the decorative part consists of embossed and depressed patterns, which are alternately arranged.

In accordance with yet another aspect of the present invention, there is provided a method of manufacturing a door for drum type washing machines, comprising: a cutting step of cutting a front member from a metal sheet; a texture forming step of forming a decorative part at the front member; and an attaching step of attaching the front member to a door frame, wherein the decorative part is formed such that reflective and nonreflective patterns are alternately arranged at the texture forming step.

Preferably, the patterns of the decorative part are formed in an embossed and depressed structure by etching at the texture forming step.

According to the present invention, the front member is attached to the front surface of the door frame. Consequently, the strength of the door frame is considerably increased without forming the door frame of a metallic material or another special material.

As the strength of the door frame is increased by the provision of the front member as described above, the door glass is stably supported by the door frame although load of the door glass is increased as the size of the door is increased.

Also, the decorative part is formed at the front member of the door frame or is directly formed at the door frame. Consequently, the appearance of the door is improved.

Also, the decorative part is formed in the reflective/nonreflective or embossed/depressed structure. Consequently, glare due to diffused reflection is effectively prevented, and therefore, inconvenience to users of the drum type washing machine is decreased.

Furthermore, the appearance of the door is improved due to the decorative part. Consequently, the drum type washing machine with the decorative part has a luxurious appearance, and therefore, aesthetic desires of consumers are satisfied, and the marketability of the drum type washing machine is improved.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
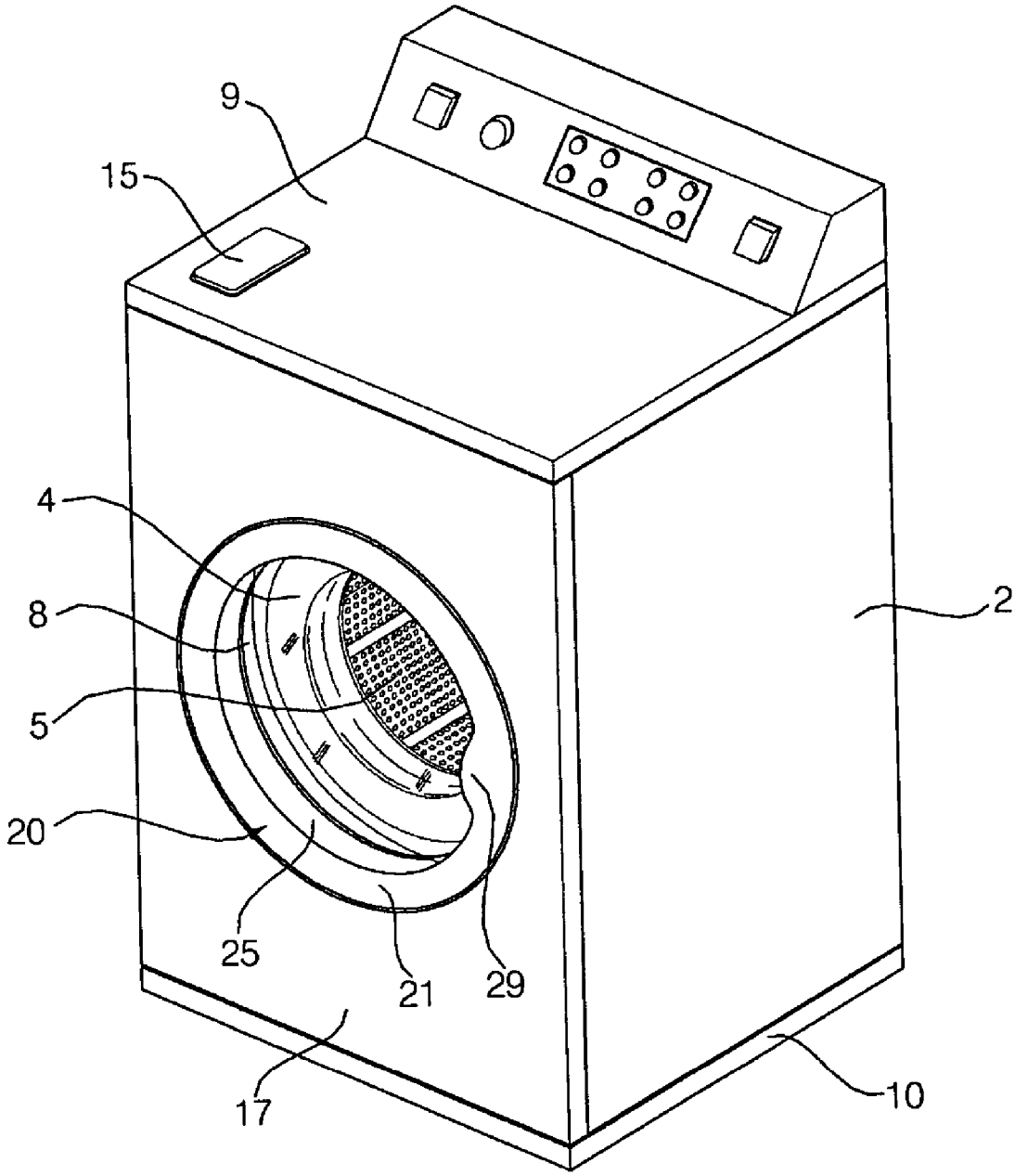
FIG. 1 (Prior Art)
FIG. 1 is a perspective view showing a conventional drum type washing machine.
Figure 2:
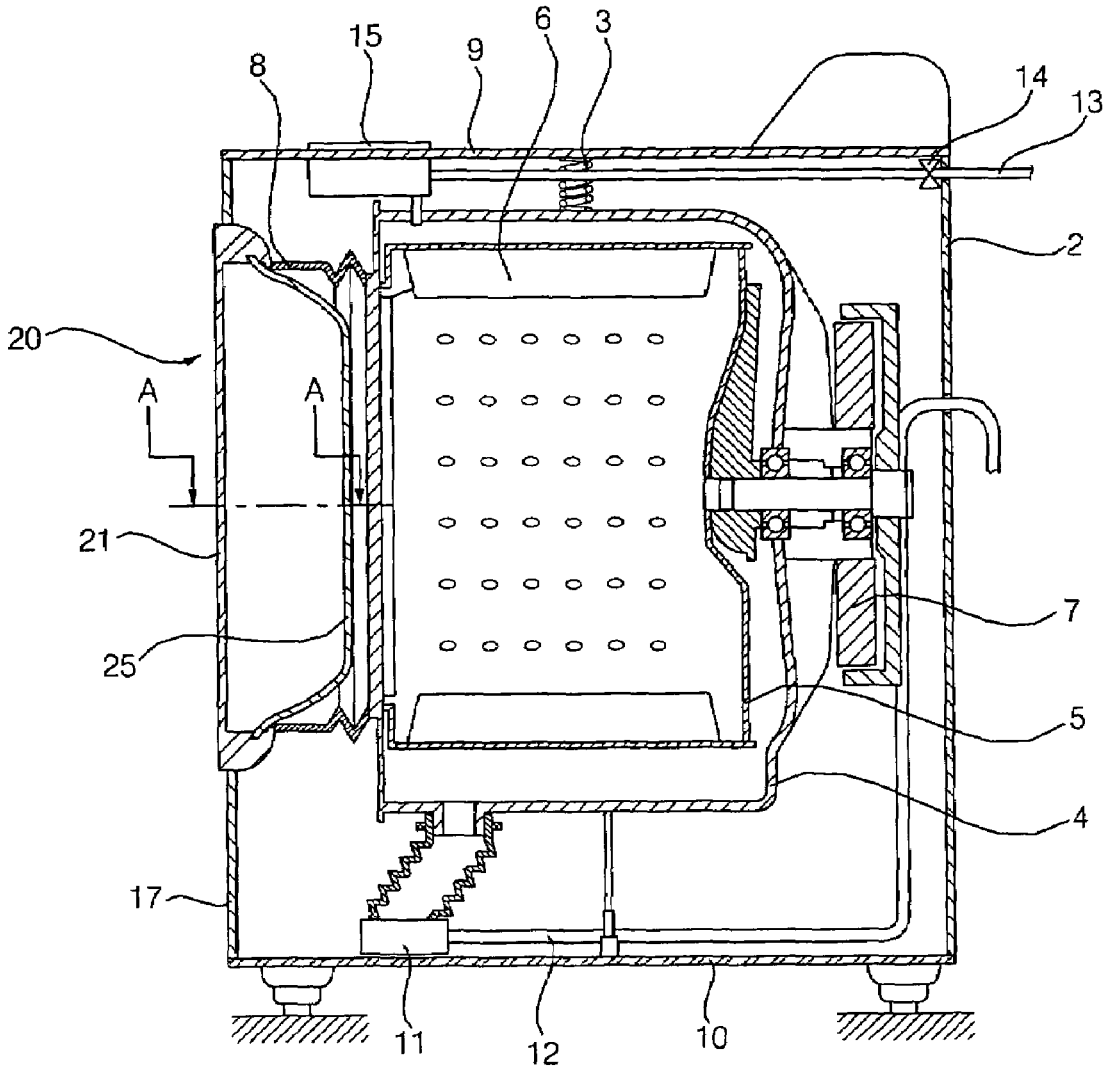
FIG. 2 (Prior Art)
FIG. 2 is a sectional side view of the conventional drum type washing machine.
Figure 3:
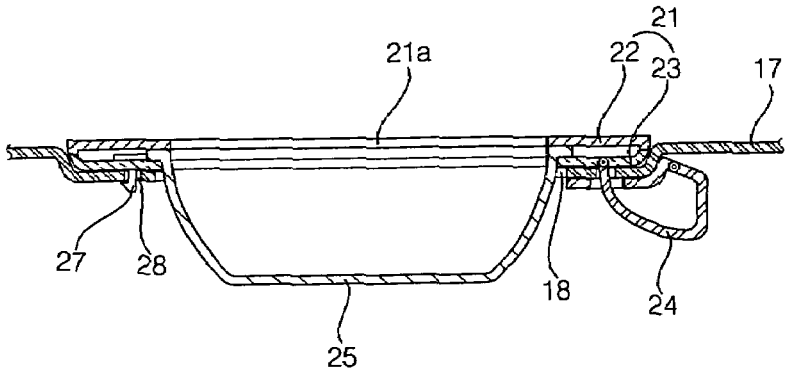
FIG. 3 (Prior Art)
FIG. 3 is a cross-sectional view of the conventional drum type washing machine seen from line A-A of FIG. 2.
Figure 4:
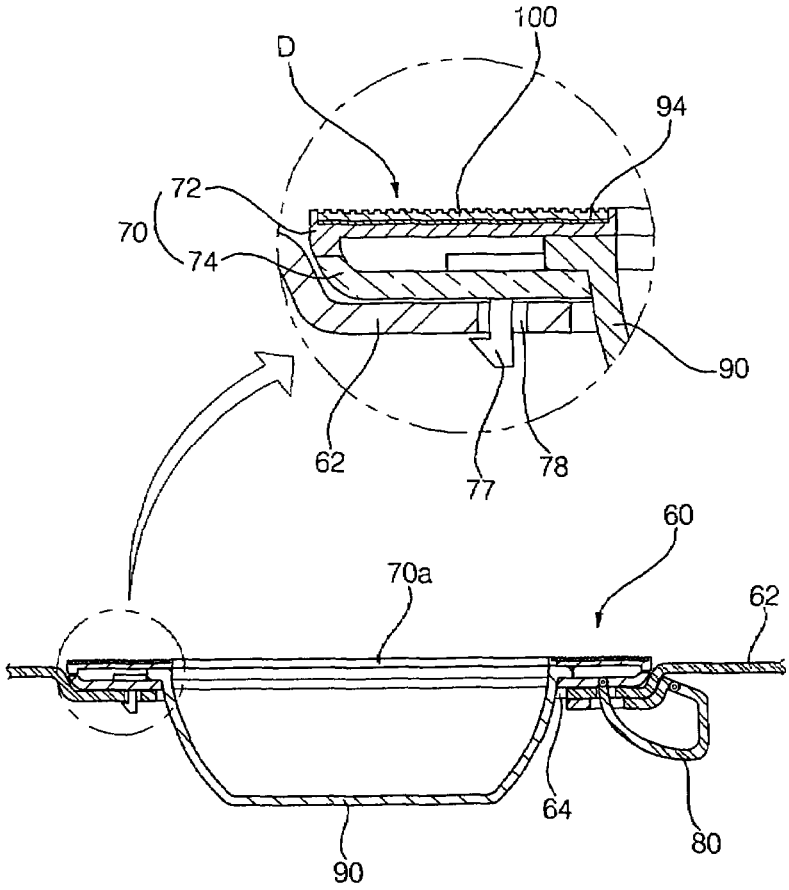
FIG. 4 is a cross-sectional view showing a door for drum type washing machines according to a first preferred embodiment of the present invention.
Figure 5:
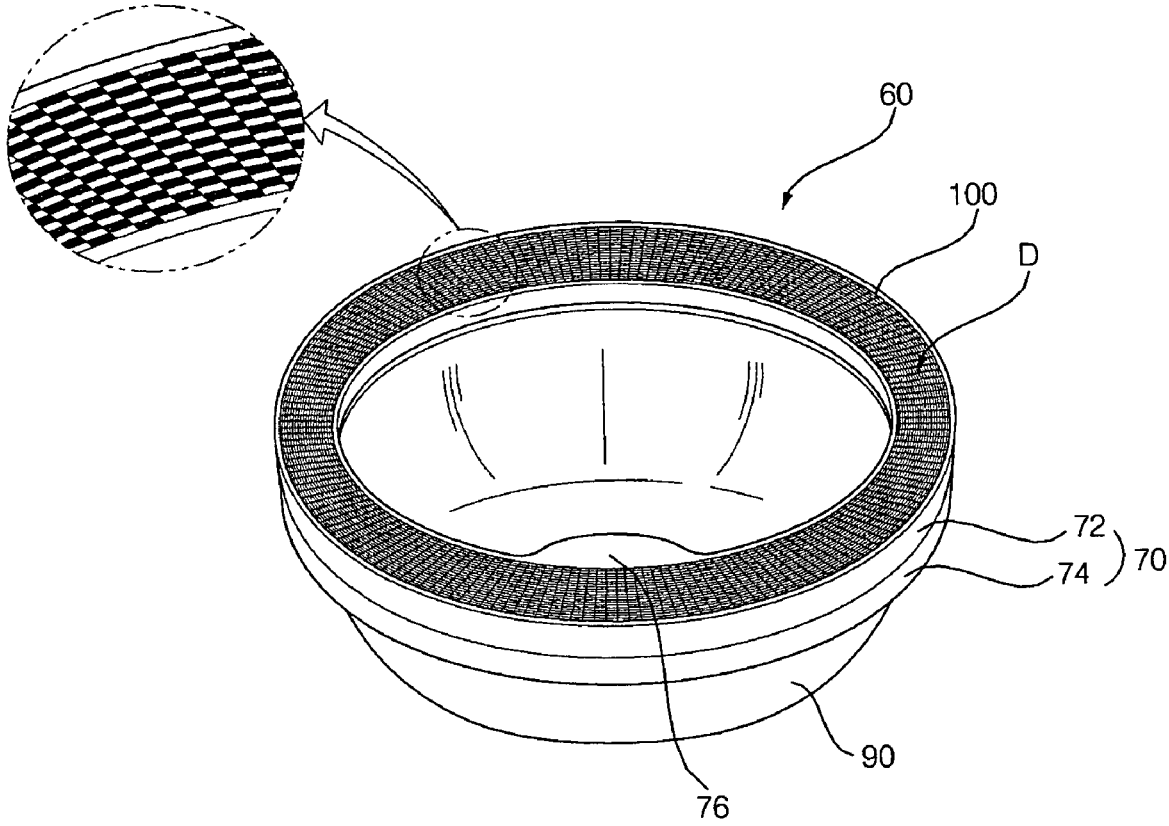
FIG. 5 is a perspective view of the door for drum type washing machines according to the first preferred embodiment of the present invention.
Figure 6:
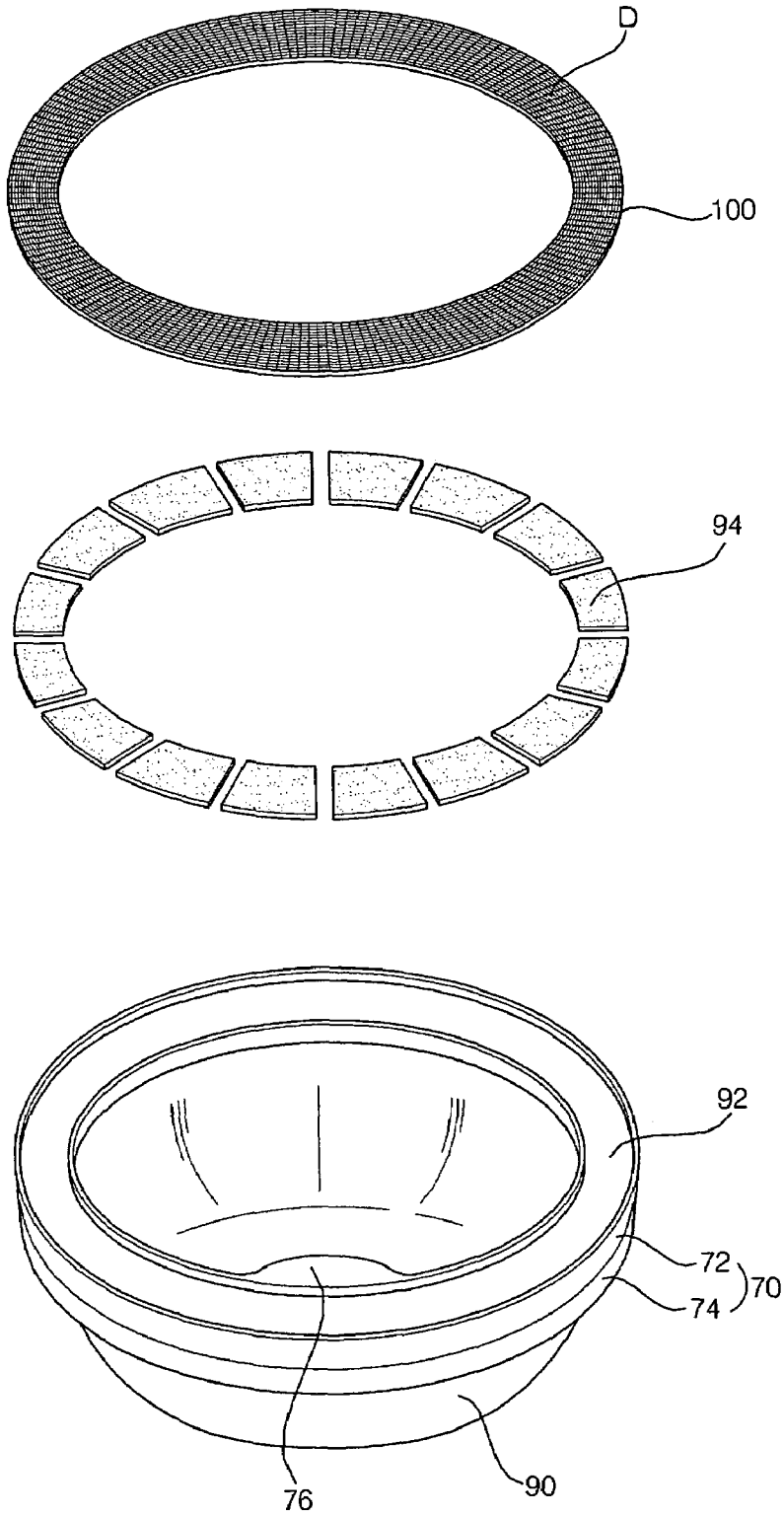
FIG. 6 is an exploded perspective view of the door for drum type washing machines according to the first preferred embodiment of the present invention.

FIG. 4 is a cross-sectional view showing a door for drum type washing machines according to a first preferred embodiment of the present invention, FIG. 5 is a perspective view of the door for drum type washing machines according to the first preferred embodiment of the present invention, and FIG. 6 is an exploded perspective view of the door for drum type washing machines according to the first preferred embodiment of the present invention.

As shown in FIGS. 4 to 6, the door for drum type washing machines according to the first preferred embodiment of the present invention comprises: a ring-shaped door frame 70 hingedly connected to a cabinet cover 62, at which a laundry inlet/outlet hole 64 is formed; a door hinge 80, having opposite ends mounted at the door frame 70 and the cabinet cover 62, respectively, for hingedly supporting the door frame 70; a door glass 90 mounted at an open center hole 70*a* formed at the door frame 70 for allowing a user to look into a drum (not shown) therethrough; and a front member 100 attached to the front surface of the door frame 70 for increasing the strength of the door 60. Preferably, the front member 100 has a sheet structure.

The door frame 70 comprises: a front door frame 72 forming the front part of the door frame 70, the front door frame 72 having a grip 76 formed at one side thereof; and a rear door frame 74 disposed at the rear of the front door frame 72 for forming the rear part of the door frame 70. One end of the door hinge 80 is mounted at the rear door frame 74.

From one side of the rear surface of the rear door frame 74 is protruded a hook 77, and the cabinet cover 62 has a hook hole 78, which corresponds to the hook 77. The door 60 is held at the laundry inlet/outlet hole 64 by securely engaging the hook 77 into the hook hole 78.

Preferably, the front door frame 72 and the rear door frame 74 are made of a nonmetallic material, which is light and has excellent injection moldability, such as plastic.

The edge of the door glass 90 is disposed between the front door frame 72 and the rear door frame 74. The center hole 70*a* of the door frame 70 is sealed by coupling the front door frame 72 with the rear door frame 74.

The front member 100 has a decorative part D, which provides a luxurious texture to the front surface of the front member 100. As shown in FIG. 5, the decorative part D is formed in the shape of a lattice. The front member 100 is securely fitted in a fitting groove 92 formed at the front surface of the door frame 70.

Specifically, the fitting groove 92, in which the front member 100 is fitted, is formed at the front surface of the front door frame 72. The fitting groove 92 is disposed along the front door frame 72 in a ring-shaped structure.

The front member 100 is a ring-shaped thin panel. The front member 100 is made of stainless steel. The decorative part D is formed at the front surface of the front member 100 to provide a luxurious texture to the front member 100 and to prevent glare.

The front member 100 may be cut from a stainless steel sheet in the shape of a single ring. Alternatively, a plurality of ring pieces may be cut from the stainless steel sheet, and then, the ring pieces may be connected to one another to form the front member 100.

The decorative part D, which is formed at the front surface of the front member 100, consists of reflective and nonreflective patterns, which are alternately disposed in a lattice structure. The nonreflective patterns are formed by etching.

Specifically, the nonreflective patterns are formed by etching, and therefore, each of the nonreflective patterns has a depressed structure having a relatively high roughness. On the other hand, the reflective patterns are not etched, and therefore, each of the nonreflective patterns has an embossed structure having a relatively low roughness.

In the illustrated embodiment, the decorative part D is formed in a lattice pattern structure consisting of continuous rectangles or diamonds.

As described above, the reflective patterns are formed in the embossed structure while the nonreflective patterns are formed in the depressed structure, although the reflective patterns may be formed in the depressed structure while the nonreflective patterns may be formed in the embossed structure according to circumstances.

In the above description, the decorative patterns are formed by etching, although the decorative patterns may be formed by grinding, photo etching, or laser etching so long as the reflective/nonreflective patterns or the embossed/depressed patterns are properly formed.

The front member 100, at which the decorative part D is formed, is forcibly fitted in the fitting groove 92 of the front door frame 72. For this reason, the front member 100 is manufactured such that the front member 100 can be forcibly fitted in the fitting groove 92.

Preferably, the front member 100 is forcibly fitted in the fitting groove 92 of the front door frame 72, and is then securely fixed to the front door frame 72 by means of an adhesive member 94.

Typically, the adhesive member 94 is a bonding agent or a double-sided adhesive tape. The adhesive member 94 is applied to the bottom surface of the fitting groove 92 before the front member 100 is fitted into the fitting groove 92. When the front member 100 is fitted into the fitting groove 92, the front member 100 is fixedly attached to the bottom surface of the fitting groove 92 by the adhesive member 94. As a result, the front member 100 is securely fixed in the fitting groove 92.

Consequently, the strength of the door 60 with the above-stated construction according to the present invention is increased by virtue of the front member 100, which is made of a metallic material. Furthermore, the door 60 has a luxurious texture and glare is effectively prevented by virtue of the decorative part D having the lattice structure, which is formed at the front member 100.

At this time, the surface of the front door frame 72 is preferably plated with a metallic material having the same color as the front member 100 to improve the appearance of the door 60.

Now, a method of manufacturing the door, having the decorative part D, for drum type washing machines with the above-stated construction according to the first preferred embodiment of the present invention will be described in detail.

Figure 7:
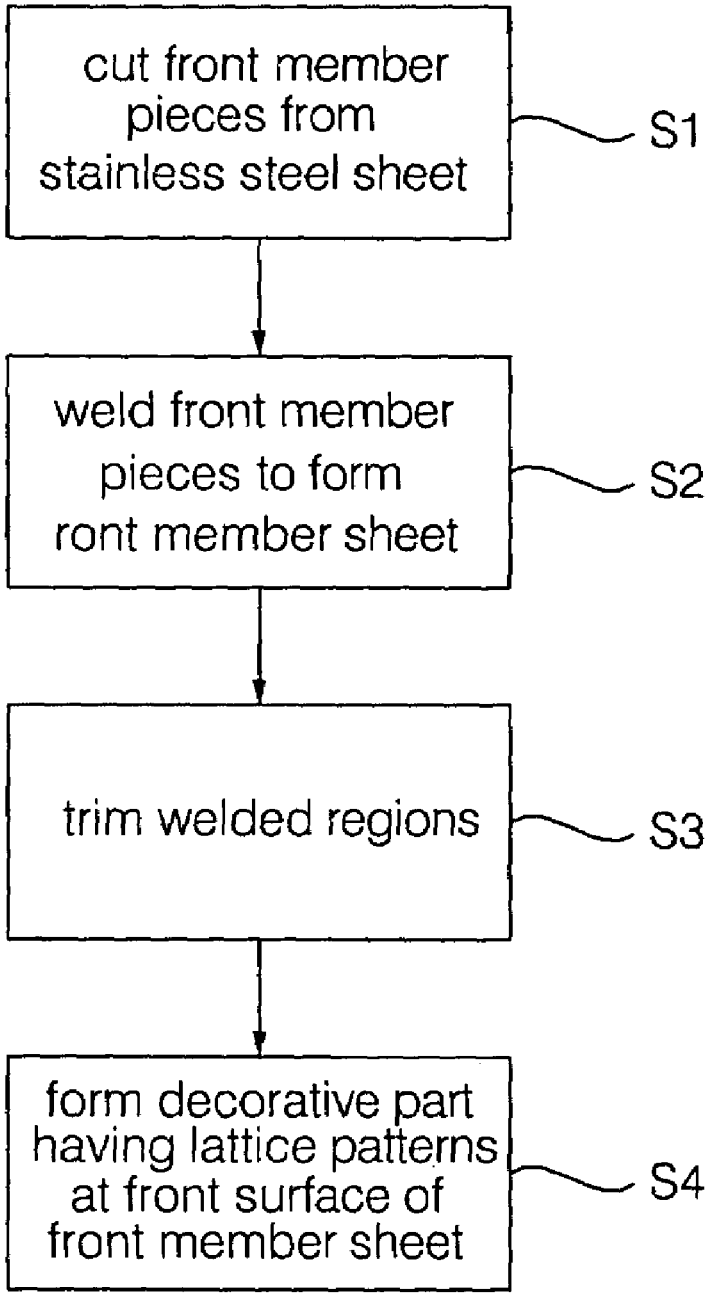
FIG. 7 is a flow chart illustrating a method of manufacturing a front member, which will be attached to the door for drum type washing machines according to the first preferred embodiment of the present invention.
Figure 8:
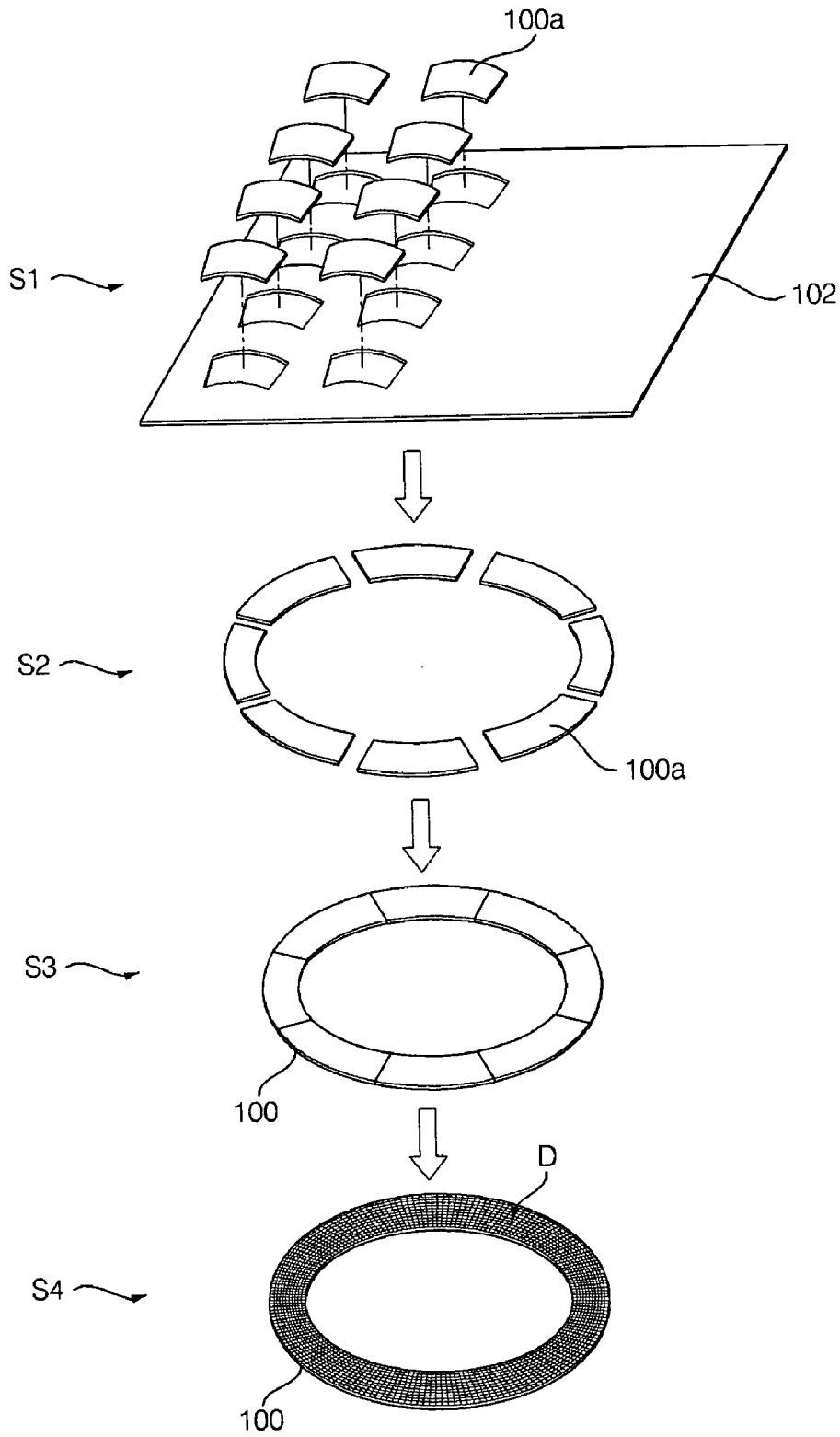
FIG. 8 is a view showing the front member manufacturing method illustrated in FIG. 7 in an orderly fashion, the front member being attached to the door for drum type washing machines according to the first preferred embodiment of the present invention.

FIG. 7 is a flow chart illustrating a method of manufacturing a front member, which will be attached to the door for drum type washing machines according to the first preferred embodiment of the present invention, and FIG. 8 is a view showing the front member manufacturing method illustrated in FIG. 7 in an orderly fashion, the front member being attached to the door for drum type washing machines according to the first preferred embodiment of the present invention.

First, the ring-shaped front member 100 is cut from a stainless steel sheet 102.

Subsequently, lattice-shaped reflective/nonreflective or embossed/depressed patterns are continuously formed at the surface of the front member 100 by etching to form the decorative part D at the surface of the front member 100.

The front member 100 having the above-described decorative part D is processed such that the front member 100 can be forcibly fitted in the fitting groove 92 of the front door frame 72. The adhesive member 94 is applied to the bottom surface of the fitting groove 92 of the door frame 70.

As the front member 100 is inserted into the fitting groove 92, the front member 100 is forcibly fitted in the fitting groove 92. At this time, the lower surface of the front member 100 is securely attached to the bottom surface of the fitting groove 92 by means of the adhesive member 94.

In this way, the front member 100 is easily and conveniently attached to the door frame 70 by simply fitting front member 100 into the fitting groove 92 of the door frame 70.

After the front member 100 is fitted in the fitting groove 92 of the door frame 70 as described above, the strength of the door frame 70 is increased by virtue of the front member 100, which is made of stainless steel.

Consequently, the strength of the door frame 70 is increased, and therefore, the door glass 90 is more stably supported, although the size of the door 60 is increased, and therefore, load of the door glass 90 is increased.

The method of manufacturing the front member 100 will be described hereinafter in more detail with reference to FIGS. 7 and 8.

At a cutting step, a plurality of front member pieces 100*a* are cut from the stainless steel sheet 102 to manufacture the front member 100 (see S1).

The stainless steel sheet 102 is a flat member having a predetermined area. The front member pieces 100*a* are cut from the stainless steel sheet 102 by pressing.

The front member pieces 100*a* are formed in the shape of an arc having a predetermined angle. The front member pieces 100*a* are attached to one another in the shape of a ring, and as a result, the front member 100 is completed.

Specifically, each front member piece 100*a* is one of the front member 100, from which the front member pieces 100*a* are divided at the same angular intervals. The front member pieces 100*a* are formed in the shape of an arc having a predetermined angle.

At a welding step, the front member pieces 100*a*, which have been cut at the cutting step, are attached to one another by welding to form a ring-shaped front member 100 (see S2).

At this time, opposite ends of the front member pieces 100*a* are connected to each other by welding.

At a trimming step, welded regions of the front member 100, which have been formed at the welding step, are trimmed by grinding (see S3).

As a result, the front surface of the front member 100 is made flat and smooth. Furthermore, discolored regions of the front member 100, which have been formed at the welding step, are removed.

At a texture forming step, the decorative part D consisting of lattice patterns is formed at the front surface of the front member 100, which has been trimmed at the trimming step, by etching (see S4).

Using the above-described method of manufacturing the front member 100 prevents waste of the stainless steel sheet 102 as compared to using the method of directly cutting the ring-shaped front member 100 from the stainless steel sheet 102.

The front member 100, at which the decorative part D is formed by the above described method, is attached to the door frame 70 by means of the adhesive member 94, as shown in FIG. 6.

Figure 9:
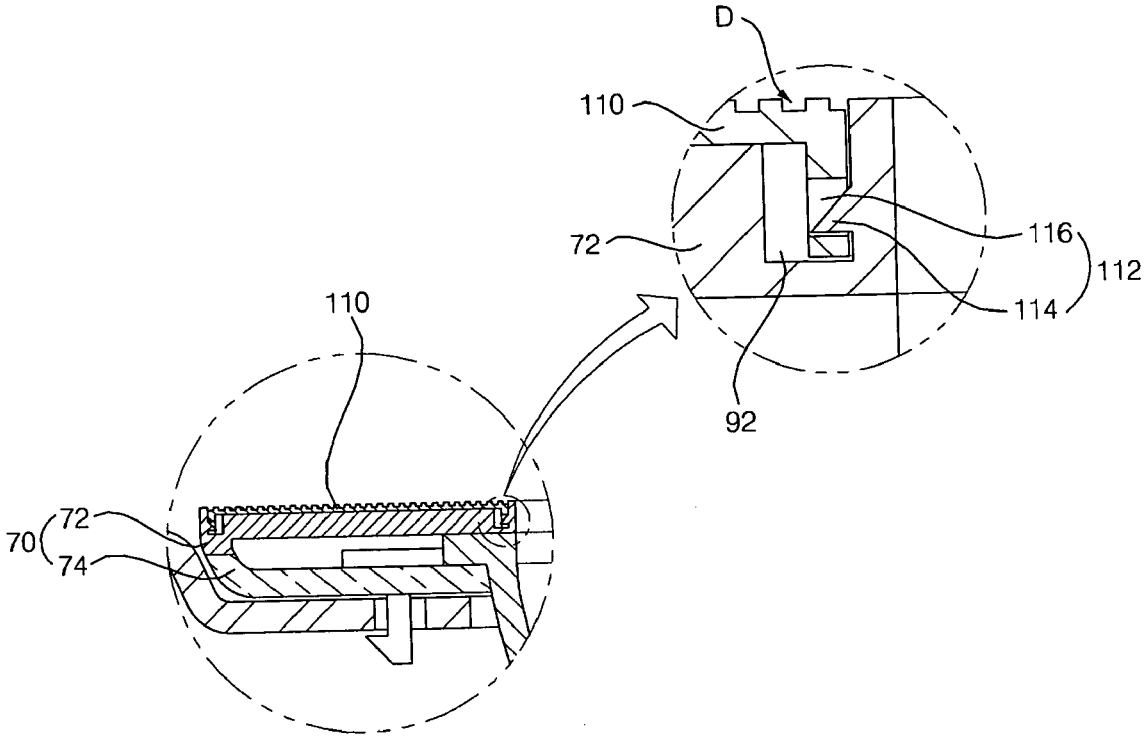
FIG. 9 is a cross-sectional view showing main components of a door for drum type washing machines according to a second preferred embodiment of the present invention.
Figure 10:
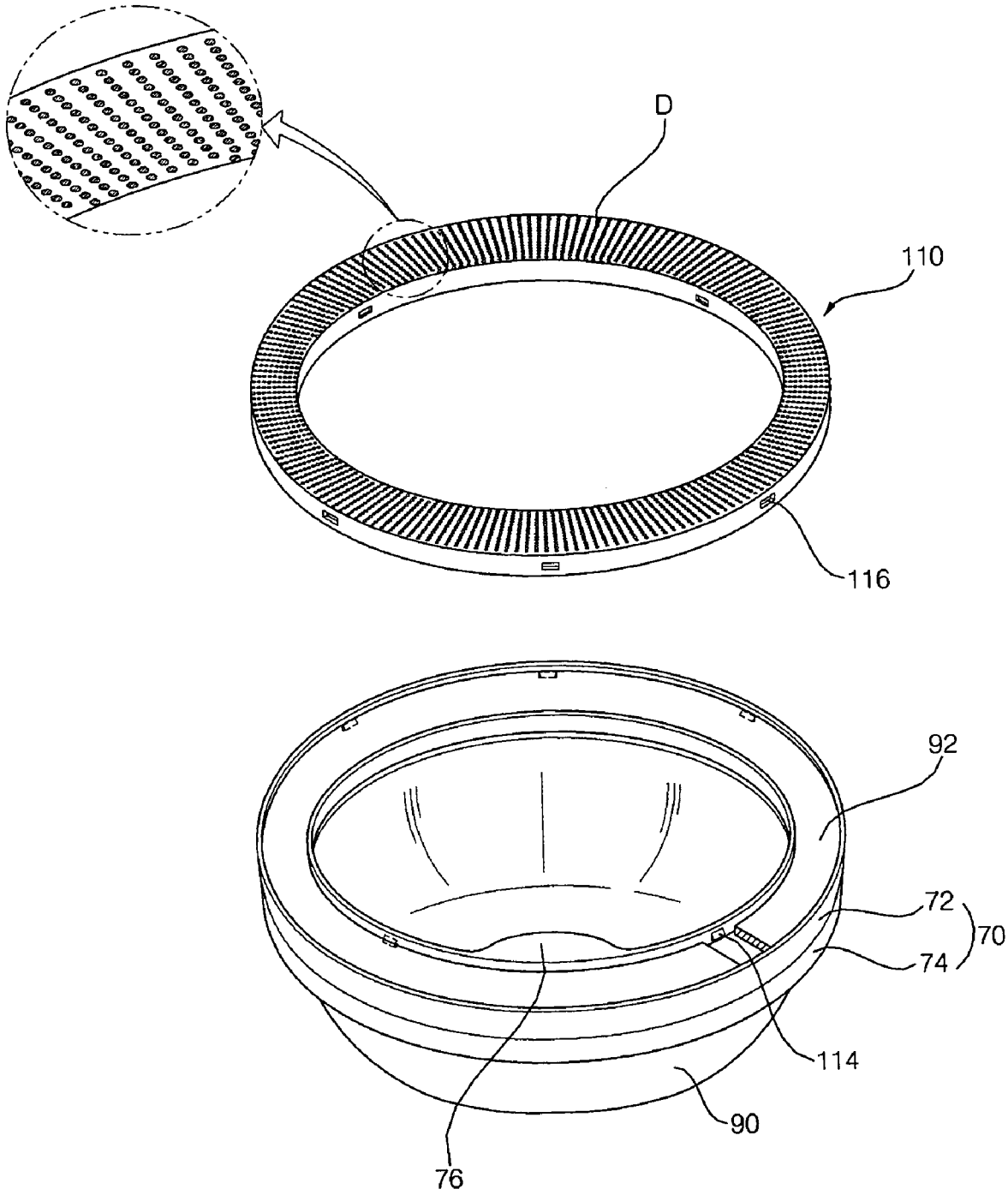
FIG. 10 is an exploded perspective view, partially cutaway, showing the door for drum type washing machines according to the second preferred embodiment of the present invention.
Figure 11A:
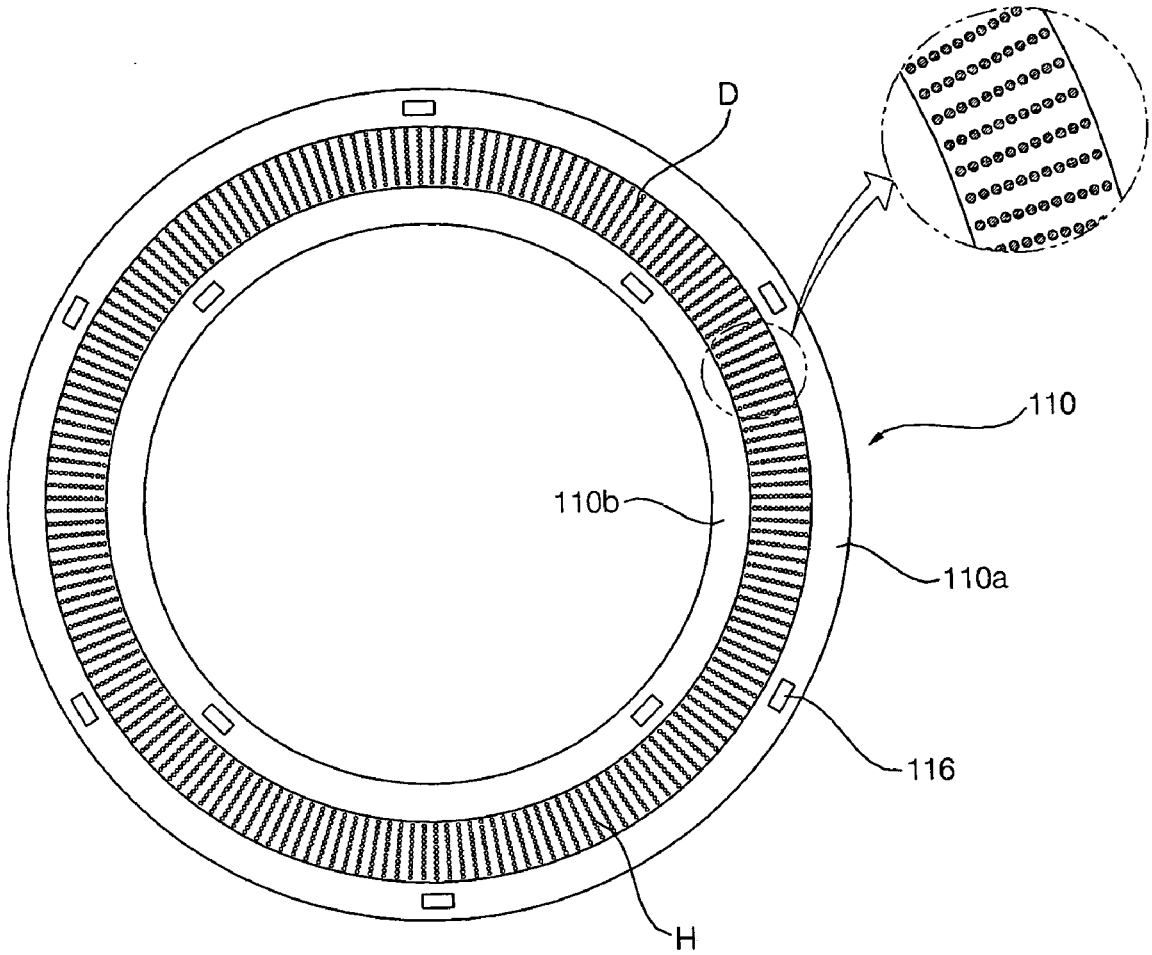
FIG. 11A is a plan view showing a front member according to a second preferred embodiment of the present invention before the front member is bent.
Figure 11B:
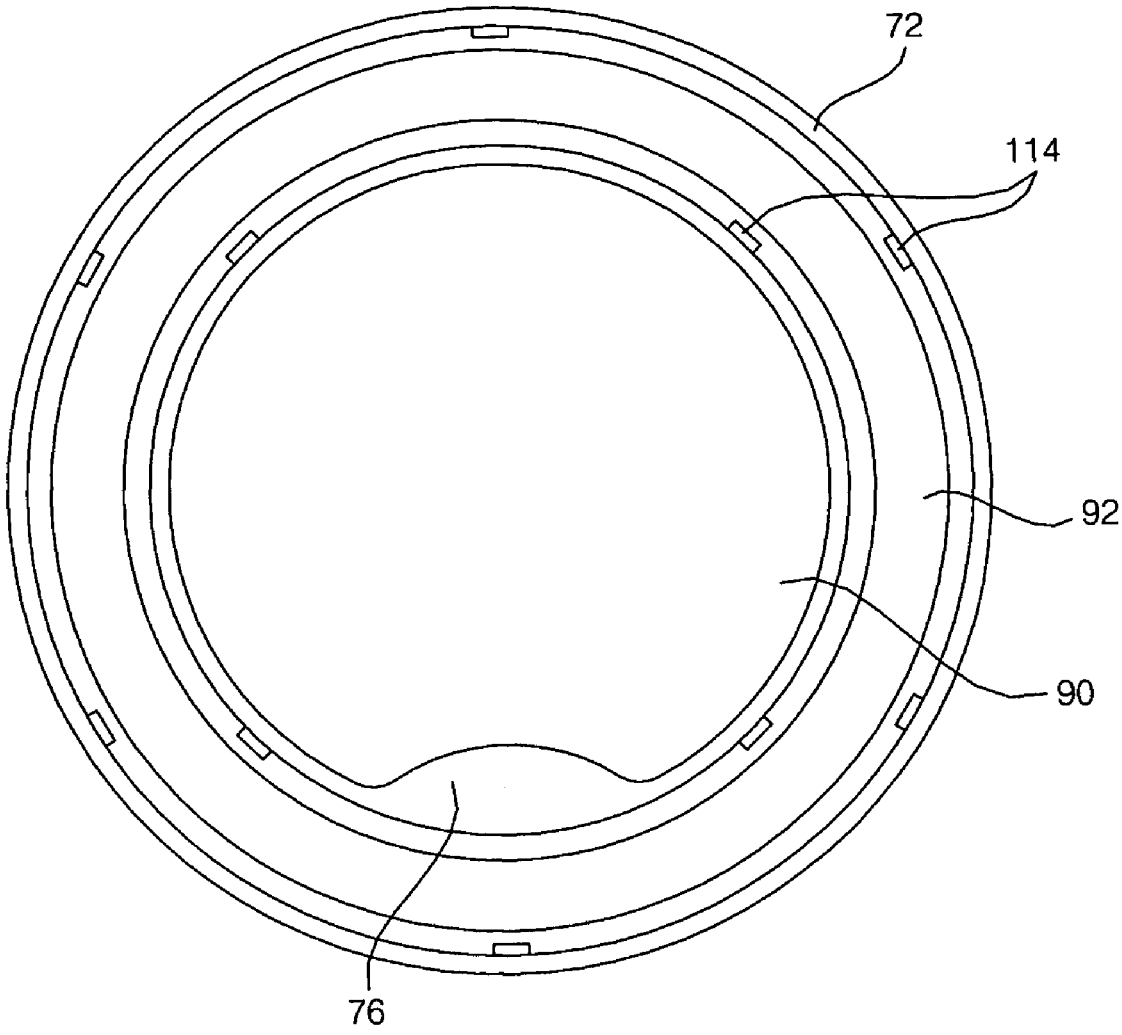
FIG. 11B is a plan view showing the front surface of the door, from which the front member according to the second preferred embodiment of the present invention is separated.

FIG. 9 is a cross-sectional view showing main components of a door for drum type washing machines according to a second preferred embodiment of the present invention, FIG. 10 is an exploded perspective view, partially cutaway, showing the door for drum type washing machines according to the second preferred embodiment of the present invention, FIG. 11A is a plan view showing a front member according to a second preferred embodiment of the present invention before the front member is bent, and FIG. 11B is a plan view showing the front surface of the door, from which the front member according to the second preferred embodiment of the present invention is separated.

Components of the door for drum type washing machines according to the second preferred embodiment of the present invention, which are identical or similar in construction to those of the door for drum type washing machines according to the first preferred embodiment of the present invention, are indicated by the same reference numerals as those of the door for drum type washing machines according to the first preferred embodiment of the present invention, and a detailed description thereof will not be given.

As shown in FIGS. 9 to 11A and 11B, the door for drum type washing machines according to the second preferred embodiment of the present invention is identical in construction to the door for drum type washing machines according to the first preferred embodiment of the present invention except that the decorative part D formed at the front surface of the front member 110 has patterns different from the patterns formed at the decorative part D of the front member 110 according to the first preferred embodiment of the present invention and that the front member 110 is securely fixed in the fitting groove 92 formed at the front surface of the door frame 70 by means of an engaging unit 112.

Specifically, the decorative part D has patterns consisting of a plurality of circles, which are continuously arranged. The patterns of the decorative part D are formed by etching the circles such that the circles are depressed. Preferably, the remaining regions of the decorative part D are not etched, and therefore, the remaining regions of the decorative part D are embossed. The embossed regions of the decorative part D are smoother than the depressed regions of the decorative part D.

The engaging unit 112 comprises: engaging protrusions 114 formed at the fitting groove 92; and engaging holes 116 formed at the front member 110 such that the engaging protrusions 114 are engaged in the engaging holes 116, respectively.

The engaging holes 116 are formed at inner and outer edges 110*a* and 110*b* of the front member 110. The inner and outer edges 110*a* and 110*b* of the front member 110 are bent downward such that the inner and outer edges 110*a* and 110*b* of the front member 110 are brought into tight contact with the inside and outside surfaces of the fitting groove 92, respectively.

When the front member 110 is inserted into the fitting groove 92, the engaging protrusions 114 are engaged into the engaging holes 116, respectively, and therefore, the front member 110 is securely fixed in the fitting groove.

The front member 110 has a "U"-shaped section. The fitting groove 92 also has a "U"-shaped section, which corresponds to the "U"-shaped section of the front member 110. Consequently, the front member 110 is more stably located in the fitting groove 92.

Each of the engaging protrusions 114 is provided with an inclined surface, which is inclined in the direction in which the front member 110 is inserted into the fitting groove 92 such that the front member 110 is easily inserted into the fitting groove 92. However, each of the engaging protrusions 114 is not inclined in the direction in which the front member 110 is separated from the fitting groove 92, and therefore, accidental separation of the front member 110 from the fitting groove 92 is prevented.

As described above, the engaging protrusions 114 correspond to the engaging holes 116. The engaging holes 116 are formed at a predetermined interval in the circumferential direction of the front member 110, and the engaging protrusions 114 are formed at a predetermined interval in the circumferential direction of the fitting groove 92.

Now, a method of manufacturing the door for drum type washing machine, having the decorative part D, with the above-stated construction according to the second preferred embodiment of the present invention will be described in detail.

First, the ring-shaped front member 110 is directly cut from the stainless steel sheet 102, and then, a plurality of circles are continuously formed at the front surface of the front member 110 by etching. As a result, the decorative part D is formed at the front surface of the front member 110.

The front member 110 is formed such that the inner edge 110*b* and the outer edge 110*a* extend from the front member 110. At the inner edge 110*b* and the outer edge 110*a* are formed pluralities of engaging holes 116, which are spaced apart from each other in the circumferential direction.

The edges 110*a* and 110*b* of the front member 110, at which the engaging holes 116 are formed, are bent downward such that the bent edges 110*a* and 110*b* of the front member 110 are brought into tight contact with the inside and outside surfaces of the fitting groove 92 when the front member 110 is inserted into the fitting groove 92 of the door frame 70. The decorative part D is not formed at the edges 110*a* and 110*b* of the front member 110.

When the front member 110 is inserted into the fitting groove 92 of the door frame 70, the bent edges of the front member 110 are brought into contact with the opposite side surfaces of the fitting groove 92, and therefore, the engaging protrusions 114 formed at the fitting groove 92 are engaged into the corresponding engaging holes 116.

Each of the engaging protrusions 114 is inclined in the direction in which the front member 110 is inserted into the fitting groove 92, and therefore, the front member 110 is easily inserted into the fitting groove 92. However, each of the engaging protrusions 114 is not inclined in the direction in which the front member 110 is separated from the fitting groove 92, and therefore, accidental separation of the front member 110 from the fitting groove 92 is prevented.

As described above, the decorative part D and the engaging holes 116 are formed at the front member 110, and the edges 110*a* and 110*b* of the front member 110 are bent downward. After that, the front member 110 is forcibly fitted into the fitting groove 92 of the door frame 70.

Other steps of the method of manufacturing the door for drum type washing machines having the decorative part D according to the second preferred embodiment of the present invention are identical to those of the method of manufacturing the door for drum type washing machines having the decorative part D according to the first preferred embodiment of the present invention, and a detailed description thereof will not be given.

Figure 12:
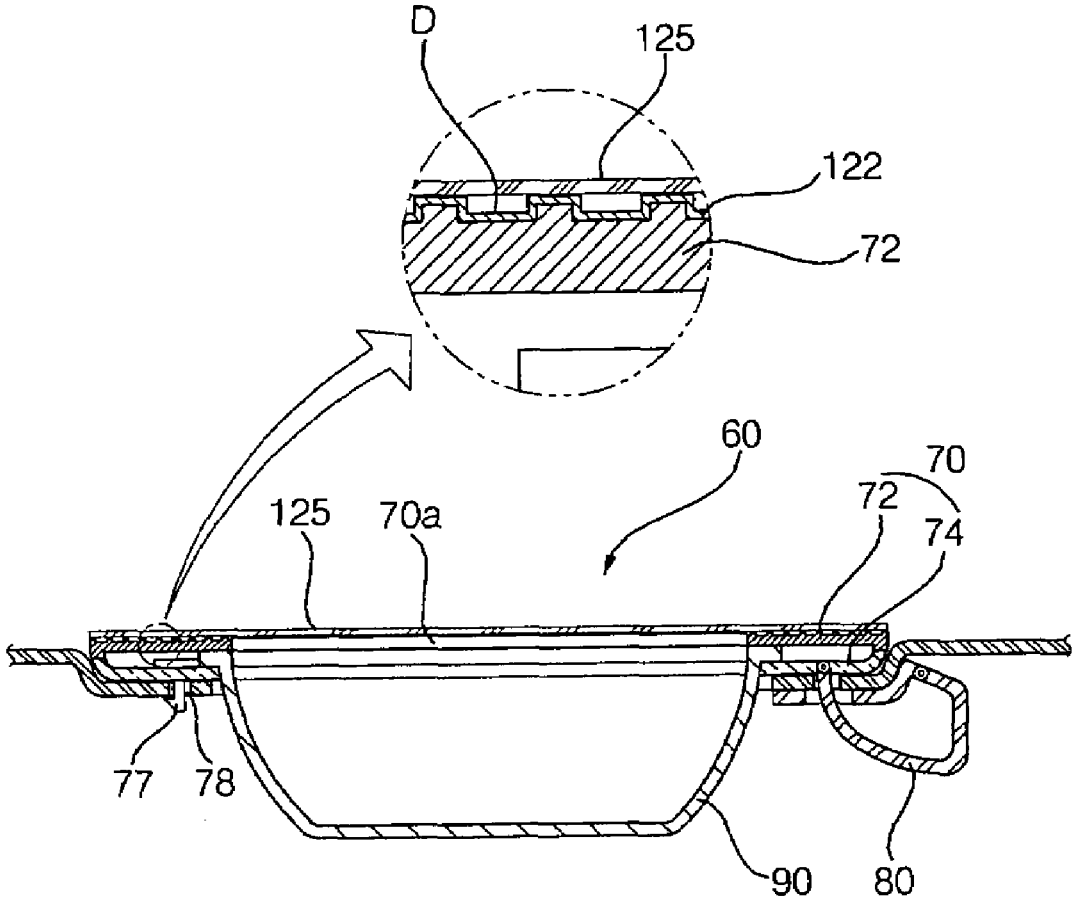
FIG. 12 is a cross-sectional view showing a door for drum type washing machines according to a third preferred embodiment of the present invention.
Figure 13:
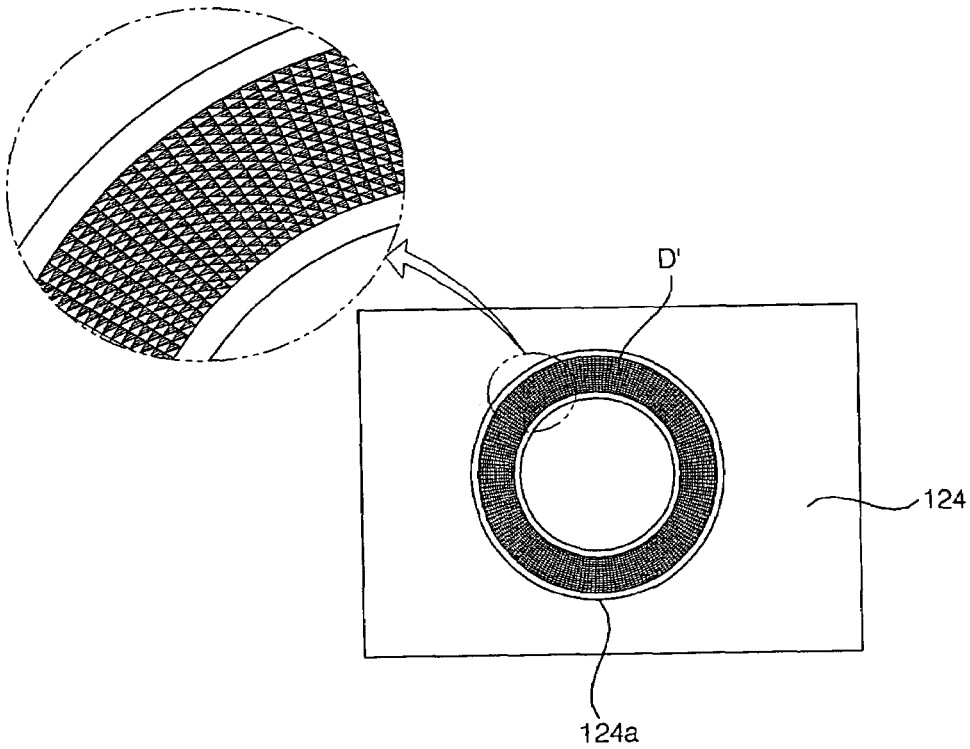
FIG. 13 is a plan view showing the interior of an injection mold used to form a door frame according to a third preferred embodiment of the present invention.

FIG. 12 is a cross-sectional view showing a door for drum type washing machines according to a third preferred embodiment of the present invention, and FIG. 13 is a plan view showing the interior of an injection mold used to form a door frame according to a third preferred embodiment of the present invention.

Components of the door for drum type washing machines according to the third preferred embodiment of the present invention, which are identical or similar in construction to those of the door for drum type washing machines according to the first preferred embodiment of the present invention, are indicated by the same reference numerals as those of the door for drum type washing machines according to the first preferred embodiment of the present invention, and a detailed description thereof will not be given.

As shown in FIGS. 12 and 13, the door for drum type washing machines according to the third preferred embodiment of the present invention is identical in construction to the door for drum type washing machines according to the first preferred embodiment of the present invention except that the decorative part D is directly formed at the front surface of the door frame 70, and the decorative part D is plated with a metallic material.

The decorative part D is integrally formed at the front surface of the front door frame 72 when the front door frame 72 is formed by injection molding. The decorative part D is formed in a lattice structure having alternating embossed and depressed patterns.

Specifically, an injection mold 124, which is used to form the front door frame 72, is provided with a cavity 124*a*, which forms the front surface of the front door frame 72, as shown in FIG. 13. In the cavity 124*a* of the injection mold 124 is formed a decorative model D'. When the front door frame 72 is formed in the injection mold 124, the decorative part D is formed at the front surface of the front door frame 72 in a shape corresponding to the decorative model D' of the injection mold 124.

As shown in FIG. 13, the decorative model D' is formed in a lattice structure having triangular cells. As described above, the decorative model D' consists of continuous reflective/nonreflective patterns or embossed/depressed patterns.

Preferably, the triangular nonreflective or depressed patterns of the decorative model D' have roughness higher than the triangular reflective or embossed patterns of the decorative model D'. Alternatively, the triangular nonreflective or depressed patterns of the decorative model D' may have roughness lower than the triangular reflective or embossed patterns of the decorative model D'.

At the surface of the front door frame 72, at which the decorative part D is formed, is formed a metal plating layer 122, such as a chrome plating layer.

On the chrome plating layer 122 may be disposed a protective film 125, which is made of a transparent material and is formed in the shape of a disc such that the overall outer surface of the door is covered by the protective film 125.

Now, a method of manufacturing the door for drum type washing machines, having the decorative part D, with the above-stated construction according to the third preferred embodiment of the present invention will be described in detail.

Figure 14:
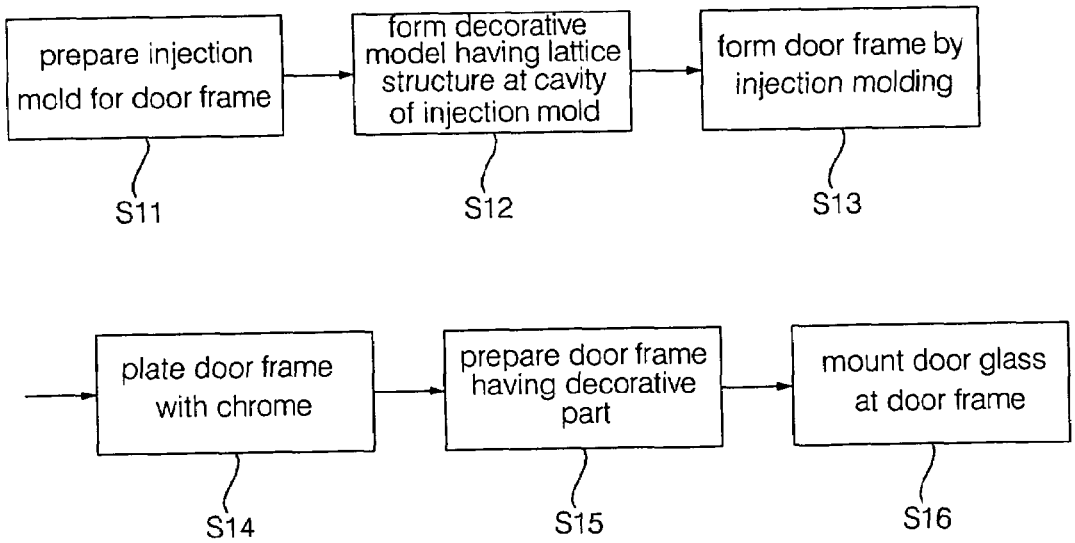
FIG. 14 is a flow chart illustrating a method of manufacturing a door with a decorative part according to a third preferred embodiment of the present invention.

FIG. 14 is a flow chart illustrating a method of manufacturing the door having the decorative part D according to the third preferred embodiment of the present invention.

At a texture forming step, the lattice-structured decorative model D' is formed at the injection mold 124, which is used to form the front door frame 72, such that the decorative part D is formed at the front surface of the injection-molded front door frame 72 (see S11 and S12).

Specifically, the decorative model D' is formed at the cavity 124*a* of the injection mold 124, which is used to form the door frame 72, by etching. For example, the decorative model D' is formed at the cavity 124*a* of the injection mold 124 by photo etching.

In an injection-molding step, the front door frame 72 is injection-molded by the injection mold 124, at which the decorative model D' has been formed at the texture forming step (see S13).

As a result, the front door frame 72 is injection-molded by the injection mold 124 while the lattice-structured decorative part is integrally formed at the front surface of the front door frame 72. The door frame 70 is made of a material having excellent injection moldability, low specific gravity, and predetermined strength, such as plastic.

At a plating step, the outer surface of the front door frame 72, which has been injection-molded at the injection-molding step, is plated with a metallic material, which provides a luxurious appearance to the front door frame 72 (see S14 and S15).

Preferably, the outer surface of the front door frame 72 is plated with chrome, which has an aesthetically pleasing appearance and high abrasion resistance. As a result, a chrome plating layer 122 is formed at the front surface of the front door frame 72. The chrome plating layer 122 has a metallic luster, and therefore, the chrome plating layer 122 provides a luxurious texture as compared to the surface of synthetic resin.

In this way, the decorative part D is formed at the front surface of the door frame 70 of the door 60 for the drum type washing machines, and the decorative part D is plated with chrome. Consequently, the appearance of the door 60 becomes luxurious.

After that, the door glass 90 is mounted at the center hole 70*a* of the door frame 72 manufactured as described above, and as a result, the door 60 is completed (see S16).

Figure 15:
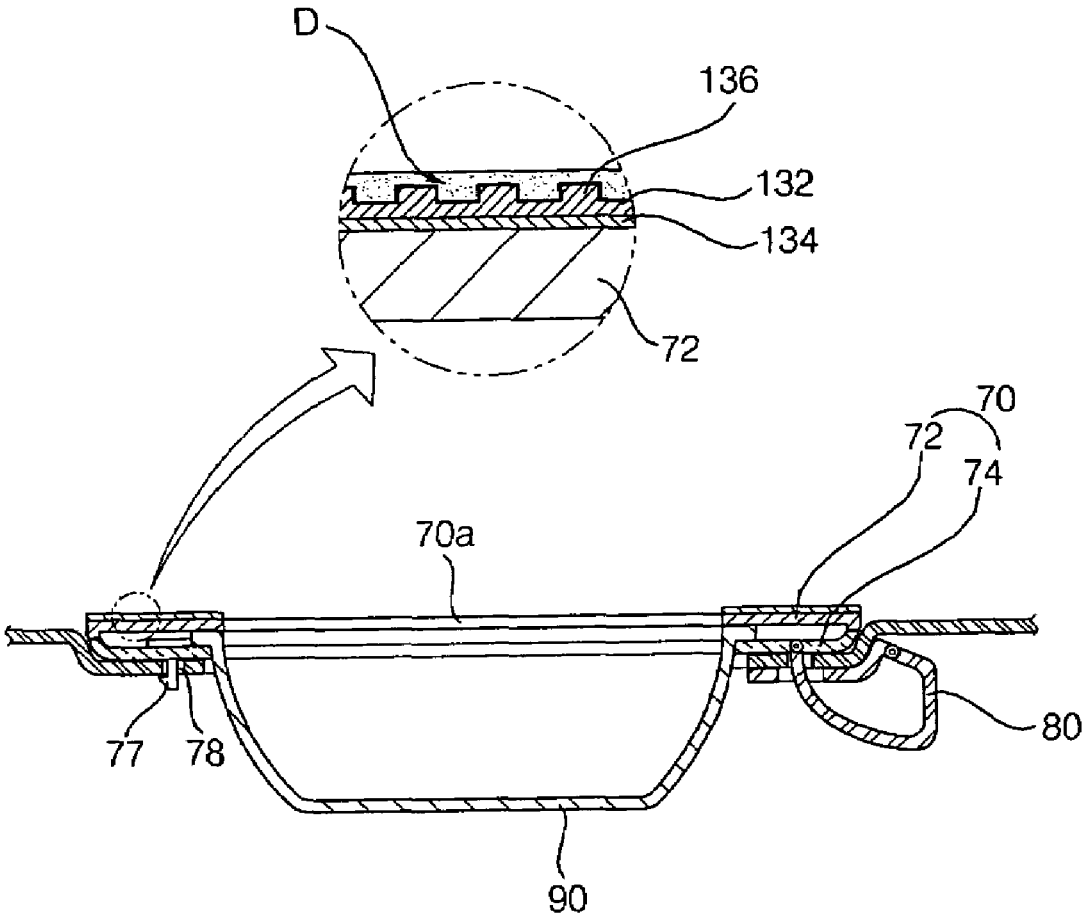
FIG. 15 is a cross-sectional view showing a door for drum type washing machines according to a fourth preferred embodiment of the present invention.

FIG. 15 is a cross-sectional view showing a door for drum type washing machines according to a fourth preferred embodiment of the present invention.

Components of the door for drum type washing machines according to the fourth preferred embodiment of the present invention, which are identical or similar in construction to those of the door for drum type washing machines according to the first preferred embodiment of the present invention, are indicated by the same reference numerals as those of the door for drum type washing machines according to the first preferred embodiment of the present invention, and a detailed description thereof will not be given.

As shown in FIG. 15, the door for drum type washing machines according to the fourth preferred embodiment of the present invention is identical in construction to the door for drum type washing machines according to the first preferred embodiment of the present invention except that the decorative part D is directly formed at the front surface of the door frame 70.

At the front surface of the front door frame 72 is formed a metal plating layer 132, such as a chrome plating layer. The decorative part D is formed at the chrome plating layer 132.

The chrome plating layer 132 is processed by photo etching or laser etching such that the decorative part D is formed at the chrome plating layer 132 in an embossed/depressed structure. Preferably, the depressed regions of the decorative part D are nonreflective regions.

After the decorative part D is formed at the front surface of the front door frame 72 as described above, the front surface of the front door fame 72 is coated with a protective film 136, which protects the decorative part D.

The protective film 136 is made of a transparent material such that the decorative part D is visible although the front surface of the front door fame 72 is coated with the protective film 136. The color and luster of the protective film 136 may be changed according to consumers' preference and fashion.

Now, a method of manufacturing the door for drum type washing machines, having the decorative part D, with the above-stated construction according to the fourth preferred embodiment of the present invention will be described in detail.

Figure 16:
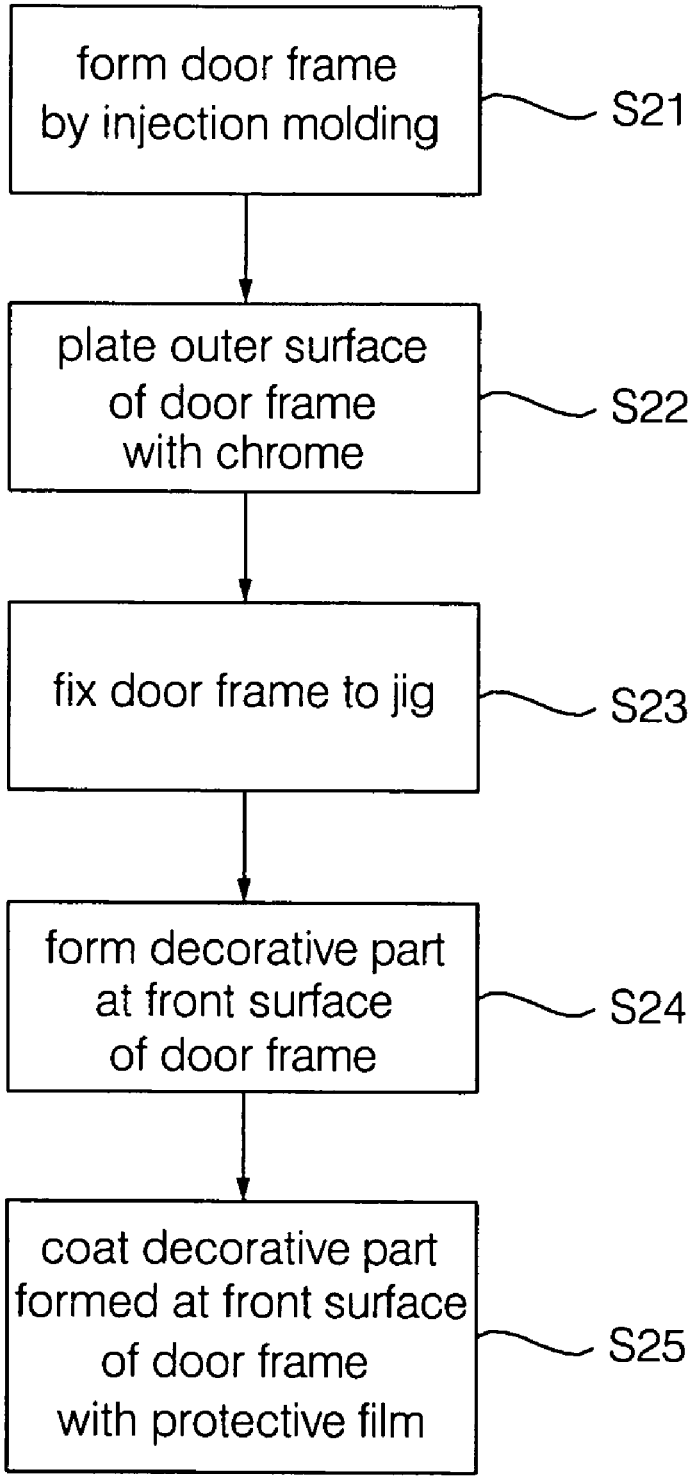
FIG. 16 is a flow chart illustrating a method of manufacturing a door with a decorative part according to a fourth preferred embodiment of the present invention.

FIG. 16 is a flow chart illustrating a method of manufacturing the door having the decorative part D according to the fourth preferred embodiment of the present invention.

At a plating step, the door frame 70, which has been made of an injection-molded plastic material, is plated with a metallic material to increase texture of the door 60 (see S21 and S22).

Specifically, the front door frame 72 of the door frame 70 is plated with the metallic material such that the appearance of the door 60 is deteriorated due to the texture of the plastic door frame 70. Preferably, the front door frame 72 is plated with chrome, which has an aesthetically pleasing appearance and high abrasion resistance.

At a texture forming step, the front surface of the front door frame 72, which has been plated with the metallic material, is processed by photo etching or laser etching such that the decorative part D is formed at the front surface of the front door frame 72 in an alternating embossed and depressed structure. As a result, the front door frame 72 has a luxurious texture (see S23 and S24).

By virtue of the decorative part D formed as described above, the front surface of the door 60 has a luxurious appearance. Furthermore, the reflection of light from the decorative part D is effectively prevented. Consequently, the marketability of the drum type washing machine, to which the door 60 according to the present invention is applied, is improved.

In a coating step, the front surface of the front door frame 72, at which the decorative part D has been formed at the texture forming step, is coated with a protective film 136 to prevent corrosion of the decorative part D or damage to the decorative part D (see S25).

Chrome, with which the front door frame 72 is plated, has excellent texture and strength. However, the chrome has a disadvantage in that the chrome is not easily attached to a plastic material. For this reason, the surface of the front door frame 72 is plated first with copper such that a copper plating layer 134 is formed on the surface of the front door frame 72, and then the surface of the copper plating layer 134 is plated with chrome such that a chrome plating layer 132 is formed on the surface of the copper plating layer 134.

Specifically, the front door frame 72 is plated with the copper, which is easily attached to the plastic material of the front door frame 72, such that the copper plating layer 134 is formed at the outer surface of the front door frame 72. After that, the surface of the copper plating layer 134 is plated with the chrome such that the chrome plating layer 132 is formed on the surface of the copper plating layer 134.

At this time, when the front door frame 72 is processed to form the decorative part D at the texture forming step, the chrome plating layer 132 is removed, and therefore, the copper plating layer 134 is partially exposed to the outside. The copper is a corrosive material, although the chrome is a non-corrosive material. As a result, the exposed copper plating layer 134 is corroded during etching, and therefore, the appearance of the door 60 is deteriorated.

In order to prevent corrosion of the door frame 70 as described above, the front surface of the front door frame 72, at which the decorative part D has been formed, is coated with a corrosion-resistant protective film 136.

Also, the protective film 136 prevents collapse of the decorative part D or damage to the decorative part D due to external impact. Furthermore, the surface of the front door frame 72, which may be rough due to the alternating embossed and depressed structure of the decorative part D, is made smooth by the protective film 136.

In addition, the protective film 136 is made of a transparent material. Consequently, luxurious appearance of the door 60, which is provided by forming the chrome plating layer 132 and the decorative part D, visually appeals to consumers.

The color and luster of the protective film 136 may be changed based on material for the protective film 136 and a coating method. Consequently, appropriate texture may be provided at the front surface of the door frame 70 as necessary.

In the illustrated embodiments, the patterns of the decorative part are formed in the triangular or rectangular lattice structure or the circular structure, although the patterns of the decorative part may be formed in various different structures so long as the reflective/nonreflective or embossed/depressed structure is accomplished.

As apparent from the above description, the present invention has the following effects.

The front member is attached to the front surface of the door frame. Consequently, the strength of the door frame is considerably increased without forming the door frame of a metallic material or another special material.

As the strength of the door frame is increased by the provision of the front member as described above, the door glass is stably supported by the door frame although load of the door glass is increased as the size of the door is increased.

Also, the decorative part is formed at the front member of the door frame or is directly formed at the door frame. Consequently, the appearance of the door is improved.

Also, the decorative part is formed in the reflective/nonreflective or embossed/depressed structure. Consequently, glare due to diffused reflection is effectively prevented, and therefore, inconvenience to users of the drum type washing machine is decreased.

Furthermore, the appearance of the door is improved due to the decorative part. Consequently, the drum type washing machine with the decorative part has a luxurious appearance, and therefore, aesthetic desires of consumers are satisfied, and the marketability of the drum type washing machine is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A door for drum type washing machines, comprising:

a door frame hingedly connected to a cabinet;

a door glass disposed to seal an interior side of the door frame, an edge of the door glass being supported by the door frame; and a front member attached to the front surface of the door frame, the front member having a decorative part which is formed at the front surface thereof, the decorative part comprising reflective and nonreflective patterns which are alternately arranged.

2. The door as set forth in claim 1, wherein the front member is formed in a sheet structure such that the front member is attached to the front surface of the door frame.

3. The door as set forth in claim 1, wherein the front member is a metal plating layer formed at the front surface of the door frame.

4. The door as set forth in claim 1, wherein the reflective and nonreflective patterns of the decorative part are alternately arranged in an embossed and depressed structure.

5. The door as set forth in claim 4, wherein the embossed and depressed structures are formed by etching.

6. The door as set forth in claim 1, wherein the reflective and nonreflective patterns of the decorative part are arranged in a lattice pattern structure.

7. The door as set forth in claim 1, wherein at least one of the reflective and nonreflective patterns of the decorative part is formed in the shape of a circle, a rectangle, or a triangle.

8. The door as set forth in claim 1, further comprising: a protective film for protecting the decorative part.

9. A door for drum type washing machines, comprising:

a door frame hingedly connected to a front cover of a cabinet;

a door glass supported by the door frame; and a decorative part disposed at the front surface of the door frame, wherein the decorative part comprising reflective and nonreflective patterns, which are alternately arranged, the front cover of the cabinet being devoid of the alternatively arranged reflective and nonreflective patterns.

10. The door as set forth in claim 9, wherein the decorative part is directly formed at the front surface of the door frame.

11. The door as set forth in claim 9, further comprising:

a metal plating layer formed at the surface of the decorative part.

12. The door as set forth in claim 9, further comprising:

a metal plating layer formed at the door frame, wherein the decorative part is disposed on the metal plating layer.

13. The door as set forth in claim 12, further comprising: a protective film coated on the surface of the metal plating layer.

14. The door as set forth in claim 9, wherein the reflective and nonreflective patterns of the decorative part are alternately arranged in an embossed and depressed structure.

15. The door as set forth in claim 9, wherein the embossed and depressed structures are formed by etching.

16. The door as set forth in claim 9, wherein the reflective and nonreflective patterns of the decorative part are arranged in a lattice pattern structure.

17. The door as set forth in claim 9, wherein at least one of the reflective and nonreflective patterns of the decorative part is formed in the shape of a circle, a rectangle, or a triangle.

18. The door as set forth in claim 9, further comprising: a protective film for protecting the decorative part.

19. A door for drum type washing machines, comprising:

a door frame hingedly connected to a front cover of a cabinet;

a door glass supported by the door frame; and a front member attached to the front surface of the door frame, wherein the front member has a decorative part comprising embossed and depressed patterns, which are alternately arranged, the front cover of the cabinet being devoid of the embossed and depressed patterns.

20. A door for drum type washing machines, comprising:

a door frame hingedly connected to a front cover of a cabinet;

a door glass supported by the door frame; and a decorative part disposed at the front surface of the door frame, wherein the decorative part comprising embossed and depressed patterns, which are alternately arranged, the front cover of the cabinet being devoid of the embossed and depressed patterns.

21. The door as set forth in claim 20, further comprising:

a recess in the front surface of the door frame, the decorative part fitting within the recess.

* * * * *